US005503371A

United States Patent [19]

Bies

[11] Patent Number: 5,503,371

[45] Date of Patent: Apr. 2, 1996

[54] ARTICLE AND METHOD OF MAINTAINING WOODEN FENCE POSTS FROM ATTACK BY LANSCAPING EQUIPMENT

[75] Inventor: John Bies, Lexington, Ky.

[73] Assignee: Bies Technical Sales, Lexington, Ky.

[21] Appl. No.: 343,060

[22] Filed: Nov. 21, 1994

[51] Int. Cl.[6] ..... A01G 13/10

[52] U.S. Cl. ..... 256/1; 47/23; 52/170; 52/741.11; 52/736.4; 52/738.1

[58] Field of Search ..... 52/728, 170, 742; 47/23; 256/1

[56] References Cited

U.S. PATENT DOCUMENTS

| | | | |
|---|---|---|---|
| 574,641 | 1/1897 | Streator | 52/728 |
| 1,673,729 | 6/1928 | Barnes | 47/23 |
| 3,362,124 | 1/1968 | Cravens | 52/728 |
| 3,571,972 | 3/1971 | Carter, Jr. . | |
| 4,244,156 | 1/1981 | Watts | 47/23 |
| 4,700,507 | 10/1987 | Allen | 47/23 |
| 4,779,389 | 10/1988 | Landers | 52/170 |
| 4,845,889 | 7/1989 | Taylor | 47/23 |
| 5,060,416 | 10/1991 | Rohde | 47/23 |
| 5,138,806 | 8/1992 | Marx | 52/728 |

FOREIGN PATENT DOCUMENTS

| | | | |
|---|---|---|---|
| 2041694 | 11/1992 | Canada | 47/23 |
| 2461447 | 3/1981 | France | 47/23 |

*Primary Examiner*—Henry E. Raduazo
*Attorney, Agent, or Firm*—Jack E. Toliver

[57] ABSTRACT

An article and method of maintaining wooden fence posts from attack by landscaping equipment in which the base of the post is encircled with a hard plastic cuff having a smoother surface than the post such that string cutters used in edging around the fence post create a smoother and cleaner cut of the vegetation with the cuff as a backing while protecting the post from attack by the tip of the string element.

7 Claims, 2 Drawing Sheets

ARTICLE AND METHOD OF MAINTAINING WOODEN FENCE POSTS FROM ATTACK BY LANSCAPING EQUIPMENT

FIELD OF THE INVENTION

The invention pertains to the field of landscaping or with the aesthetic maintenance of grounds, the removal of grass, brush and other low height vegetation growing around fence posts, lamp posts, walls, trees and other such in-place, stationary objects.

BACKGROUND OF THE INVENTION

Landscaping and lawn maintenance crews use high-powered rotary, string cutters for the rapid removal of grass, weeds, brush and other low height vegetation growing around fence posts and other stationary objects. The string element is hard, but flexible enough to bend when it strikes an object more solid than the vegetation. It is very efficient in cutting grass and weeds, however in the process it strikes softer objects than the string itself, like a wooden fence post, and in the process, removes or chips away small pieces of the surface with the result that costly repairs are required. The land owner having many wooden fence posts "eroded" to the point of weakening the post is required to periodically replace each post over time.

This has become more of a problem as rotary string cutters have become more powerful. High-powered edgers, some of which are capable of generating rotary velocities in excess of 9,000 RPM's and the torque output of a 2 cycle, 2 horsepower engine, produce a flailing force sufficiently large to cut one inch brush and other heavy vegetation at ground level.

In the past, preventing the undesirable growth of vegetation around trees, along fence lines or next to other structures has largely focused on attempting to inhibit the growth of the vegetation rather than protecting the structure. One version includes a ring which lays flat on the ground and extends radially out from the tree at its base. The object is to prevent the growth of grass within a radius adjacent the tree trunk, not to protect the tree trunk from damage by string cutters.

Moreover these barrier devices are made of rather thin, flexible plastic materials which would disintegrate under the forceful attack of high powered edgers.

In addition, these barrier devices are expensive to manufacture, difficult to install, not especially attractive when installed and require repeated maintenance which has not led to their being adopted in any widespread commercial sense.

A vegetation barrier of the type referred to is disclosed in U.S. Pat. No. 3,571,972 issued Mar. 23, 1971.

SUMMARY OF THE INVENTION

In accordance with the present invention there is provided a method of protecting in-place ground structures from attack by landscaping equipment, particularly rotary string cutters used in edging around such structures comprising the steps of (i) removing the vegetation sufficiently from adjacent the base of the structure to expose an erosion zone several inches above the ground; and (ii) creating a harder, substantially continuous layer over the erosion zone capable of withstanding repeated impacts delivered by the tip of a string cutter.

In terms of preventing edger erosion where the ground structure is a wooden fence post, the step of creating the harder layer includes encircling the post adjacent the base near ground level with a cuff of hard plastic material slit across one side allowing it to be yieldably opened, slipped around the post, and released to contract around the post. The cuff will completely overlap the surface of the post subject to attack.

The problem of fence post erosion has become especially troublesome for horse farms with vast expanses of wooden fencing, enclosed paddocks and pastures typical in the thoroughbred racing industry. Many posts must be replaced each year because of grass cutting with high speed string cutters.

Horse farm fence post may be round or square, or may have a D-shaped cross section on which the fence planking is fastened end-to-end against the flat side of the post in four horizontal rows. Many miles of this fencing enclose the horse farms devoted to breeding thoroughbred race horses. The fences are typically painted either white or treated against weathering with a dark almost black, petroleum based tar-like coating.

In a particular embodiment of the invention the cuff is approximately the same diameter as a typical horse farm fence post, approximately six to eight inches, and is cut from continuous extruded PVC (polyvinylchloride) tubular stock colored to closely match the color of the fencing. The stock may be slit during extrusion or sawed lengthwise afterwards, and each cuff is sawed off at the end at about four inch lengths after hardening sufficiently.

A die of a D-shape may be provided in extruding the tubular stock accommodating fence posts having that cross section.

In a landscape maintenance method, prefab cuffs are available in various sizes, edging proceeds along a fence row, after each post is clear of vegetation around its base, a cuff appropriate for the post is assembled around the base of the post, and subsequent edging will not deteriorate the post.

Accordingly, the invention contemplates a method of ground maintenance where extensive wooden fence structures exist.

Still another object of the invention is an article in the form of a flexible, hard cylindrical cuff, slit on one side, fabricated such that the opposing ends tend to return in a resilient manner when spread apart enabling it to be assembled around objects.

Another object is that the cuff's outer surface has a low co-efficient of friction reducing substantially the damage to the tip of a string cutter and in the process causes the vegetation to be cut away more efficiently and cleanly near the ground, because of the hard backing provided by the cuff.

Accordingly it is an object of the invention to provide a method for protecting objects already in place in the ground from damage by equipment.

Another object is to provide a method of grounds maintenance of fence rows where the posts are subject to attack by string cutters which includes removing the grass from adjacent the base of the post, encircling each post with a plastic cuff having a lower co-efficient of friction than the surface of the post, and thereafter cutting the grass against the backing of the cuff to reduce wear and tear of the string cutter.

Another object of the invention is to provide a process of manufacturing cylindrical cuff blanks which involves the steps of extruding a continuous tube of plastic through a circular die, slitting the tube longitudinally, and cutting segments off the tube to form the blanks, the strength and thickness of which permits the blank's ends to be yieldably spread to encircle an object, and close around the object after release.

Another object of the invention useful on horse farms having vast expanses of wooden fencing is to reduce the cost of fence maintenance. Another object is to speed up the chore of edging around fence posts because of the cleaner, faster cut the edgers can make. Another object is to improve the aesthetic appearance important to the thoroughbred horse racing industry which relies to a great extent on an immaculate appearance of the grounds to impress potential investor and customers.

These and others objects will be more appreciated by reference to the following detailed description of the invention and the drawing of a preferred embodiment of the invention:

DETAILED DESCRIPTION OF A PREFERRED EMBODIMENT OF THE INVENTION

While a preferred embodiment of the invention will be illustrated with respect to protecting wooden fence posts from attack by rotary string cutters used in landscaping and ground maintenance operations it will be appreciated that the invention is not limited to this application, but has wider utility in connection with protecting any in-place ground object which is subject to repeated attack by equipment which has the tendency of destroying the aesthetic appearance or the structural integrity of the object, but moreover the invention extends to improving the general appearance while reducing the costs of maintenance of the landscape.

Figure 1:
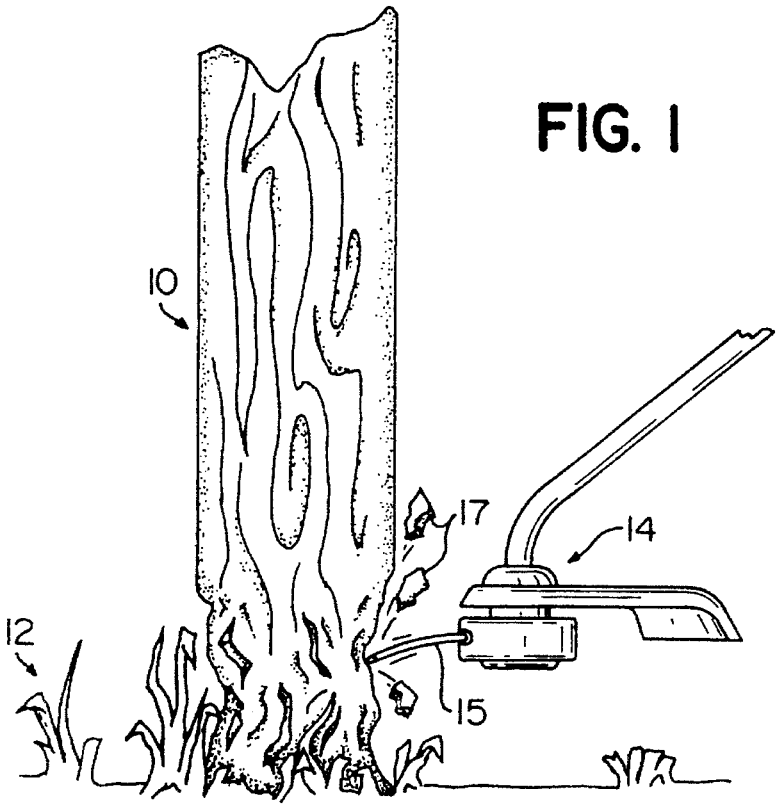
FIG. 1 is a partial elevational view of an in-the-ground object, such as a fence post, showing the surface being attacked by a string cutter during edging or grass removal from around the base of the fence post.

Referring to FIG. 1 a wooden post 10 is shown with vegetation 12 being removed in a conventional manner with a string cutter 14 having a string element 15 which in addition to cutting the vegetation 12 away from the post 10 is shown striking the base of the post and in the process removing small chucks 17 from the base of the post due to the impact of the tip of the string element 15 causing the post to be eroded around its base and structurally weakened to the point that it is in danger of breaking off near the ground.

Figure 2:
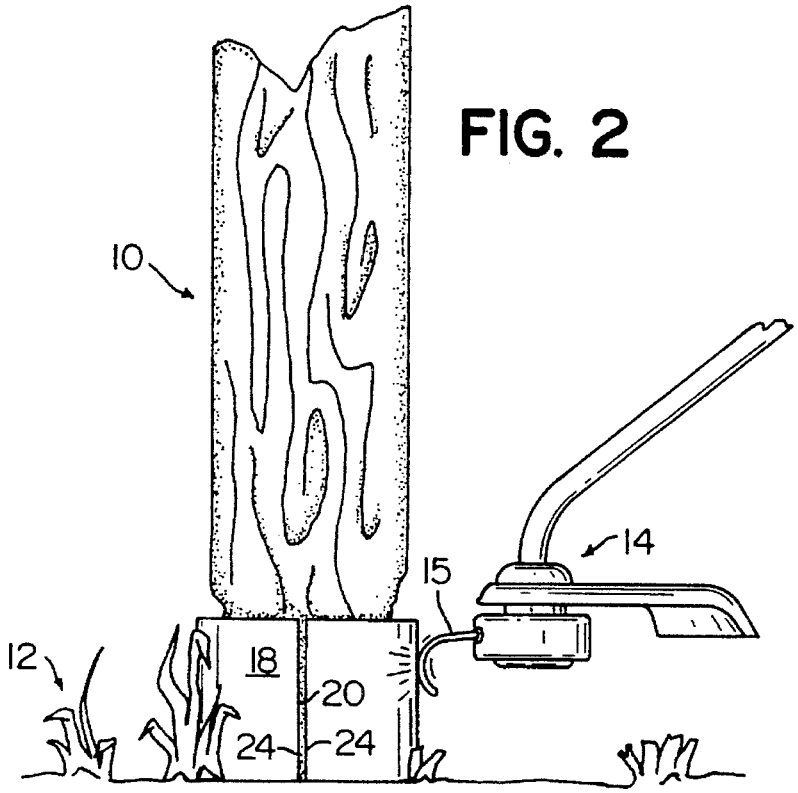
FIG. 2 is a partial view similar to FIG. 2 showing the fence post protected from attack.

In FIG. 2 the post 10 is shown protected according to the method of the present invention where a cuff 18 of a hard resilient plastic material such as polyvinylchloride (PVC) encircles the eroded area of the post preventing further nicking or chipping away of the base by the string element 15 of the cutter 14. The cutter 14 may be any one of a number of commercially available edgers or weed cutters, usually portable and having a two cycle, two horsepower gasoline engine that propels the string element 15 in excess of 9,000 RPM's. The string element 15 is a plastic or nylon filament which is extended as the tip wears due to contact with the vegetation, or with objects such as the post 10 causing the tip to break off. The PVC material from which the cuff 18 is made has a lower co-efficient of friction than the surface of the post 10 and thus reduces the wear and tear on the string element 15 while at the same time protecting the post and providing a hard backing against which the vegetation 12 is cut for a cleaner and smoother appearance.

The method involves the steps of removing or pulling back the vegetation 12 from around the post to be protected, creating a harder surface layer outwardly of the exposed, erosion zone having a co-efficient of friction about that of PVC hard plastic, or other thermosetting polymers, and edging against the hard surface instead of the fence post.

Accordingly the landscaping method employed for a series of fence posts as used in the horse farm industry is to provide sufficient numbers of cuffs for all the posts, edging to remove existing vegetation from around each post, and installing a cuff to prevent further erosion to each post. Also decay or weathering is not a problem since the cuffs will not hold moisture. Fence life is increased. Edger erosion is eliminated.

While FIGS. 1 and 2 show a post 10 that has been previously attacked by edgers and eroded around its base, the cuff 18 could be used or installed at any time, preferably before any edging has caused appreciable damage to the post, or before the post is implanted.

The cuff is fabricated of plastic material which is colored black or white to match the color of fence posts and is ultra violet stabilized so as not to deteriorate or fade in exposure to sunlight. A transverse slit 20 enables the ends to be spread apart four to six inches, or as required by the reduced diameter of an eroded post. The plastic cuff blank has a thickness and strength sufficient to impart inherent resiliency to the circular shape, for example, a wall thickness of 0.06 to 0.08 inches with a six to eight inch diameter is satisfactory.

Figure 3:
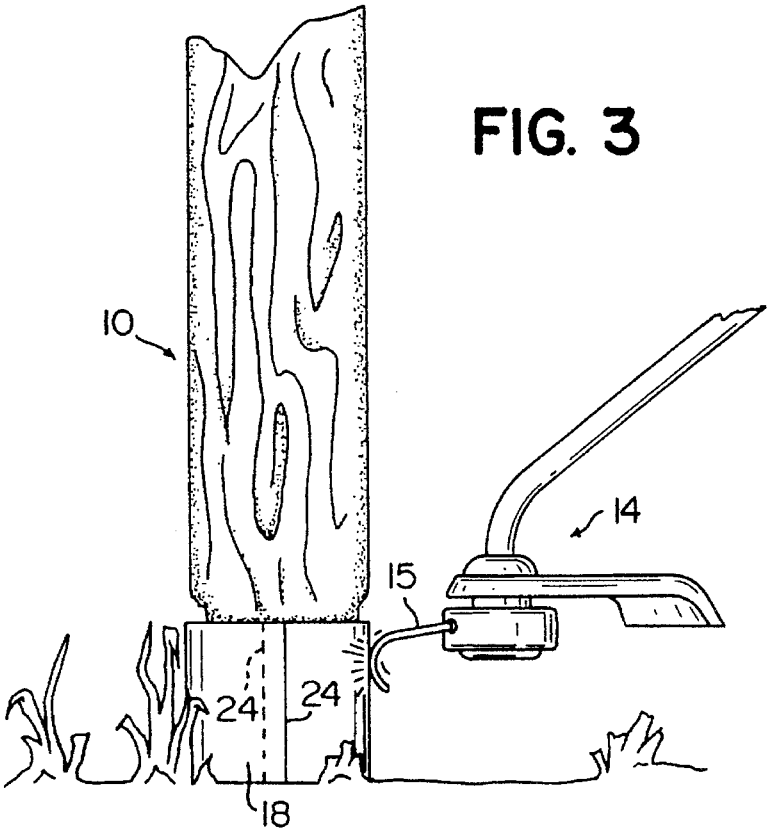
FIG. 3 is a partial view similar to FIGS. 1 and 2 showing a cuff in which the opposed ends of the cuff overlap partially.

Referring the FIG. 3 the cuff 18 is shown with the ends 24 overlapping as would be the case where the erosion of the post 10 has progressed beyond that shown in FIG. 2 and has reduced the effective diameter of the post in that location. The cuff contracts around the post after assembly so as to fit snugly around the exposed erosion zone to be protected.

Figure 4:
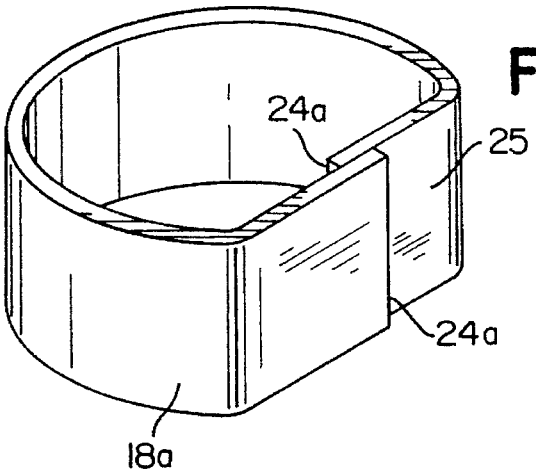
FIG. 4 is an isolated view of a cuff shape having a D cross section as a cylindrical blank cut from a longitudinal tubular stock.

FIG. 4 shows a slightly different embodiment of the invention where a cuff **18*a* has a D-shaped cross section. One side 25 of the otherwise circular cuff blank is flattened with the ends 24*a* either overlapping, as shown in FIG. 4**, or abutting as determined by the actual post size.

Figure 5:
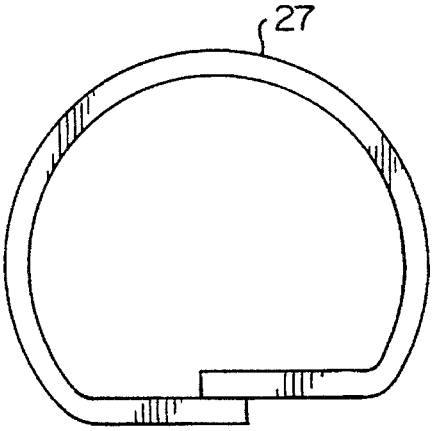
FIG. 5 is a cross section of the tubular stock slit longitudinally such that the opposing ends are yieldable overlapping in a static or unstressed condition.

It is a further feature of the invention that the cuff blanks are cut from tubular stock 27 (FIG. 5) formed in a continuous extrusion press (not shown) from which the tubular stock is extruded. The blanks are cut to form the cuffs 18, **18*a* by sawing off lengths of the tubular stock after the plastic material has hardened sufficiently. Typically four inch blanks would be cut, although this could be varied depending on requirements of the particular need. A slit is sawed lengthwise in the tubular stock 27 on the flat, or D side 25**, but it is understood that the extrusion die could also create the slit at any location on the circumference.

Wood most often used for large fenced areas, horse and cattle farms, parks, golf courses and the like are typically soft, less expensive pressure treated pine poles six to eight feet in length which fence contractors will generally install using hydraulic post extractors to remove a weakened or broken post, or power augers for digging holes for a new fence. Pressure treated pine is a relatively soft wood and will not stand up under the abrasive action of the plastic or nylon string cutter. Nylon has a tensile strength of 22,000 PSI, an impact strength of 2.2 to 2.6 ft. lb./in and a compressive strength of 29,400 PSI. The wood fibers are eroded away by the abrasive action of the tip of the nylon string exposing the untreated substrate to rapid attack from moisture and insects now able to enter the post at the erosion zone near the ground line. The cuff blanks can be made of any hard plastic or thermo-setting resin such as polyvinylchloride having an ultraviolet stabilizer additive to prevent discoloration and deterioration over time from the ultraviolet rays of the sun. The resin should have a flexibility without cracking or breaking down to approximately 15° F. allowing for installation during cold weather conditions. Depending on costs, other high density plastics may be used such as HDPE (high density polyethylene) having a tensile strength of 34,800 PSI, impact of 0.4 to 4.0 ft. lb./in. and compression of 3,000 PSI; or acrylonitrile butadiene styrene (ABS) having a tensile strength of 7,000 PSI, impact of 2.0 to 6.0 ft. lb./in. and a compression strength of 12,500 PSI are just two examples of the plastic other than PVC which may be used for the cuff blanks. Posts having the cuff installed will not need to be repainted near the ground line resulting in further cost savings in both labor and material. Posts are generally spray painted or brush painted with external enamel, usually white in the horse farm industry, or a creosote based material having a black, matt finish is applied to the fence post providing a protective covering which the cuff, if installed prior to installation of the posts, or before extensive edging has occurred will protect from being removed by the abrasive action of the string cutter, but even if installed after substantial erosion has occurred fence life will be increased and fence maintenance expenditures significantly reduced for the land owner.

The foregoing description of a preferred embodiment of the invention as illustrated in Figures referred to above are for purposes of illustration and not intended to cover every conceivable variation or to limit the invention to the precise configurations disclosed in the drawings, rather modifications or variations are possible in light of the disclosure herein. Moreover the preferred embodiment used to illustrate the invention in the best mode for carrying out the invention as described in connection with protection of wooden fence posts may be broadened to include other objects, whether made of wood, metal or some other material. While the invention is with reference to a cuff encircling an exposed surface it would also be within the contemplation of the invention to treat or impregnate the surface with a material that would harden producing a smooth, hard low co-efficient of friction surface area adjacent the ground. Therefore, It is anticipated that modifications or variations will be made that fall within the scope of the appended claims.

What is claimed as the invention is set forth as follows:

1. In landscaping existing fenced turf areas enclosed by wooden fencing comprising wooden posts of relatively uniform size and shape of generally circular cross section except for a flat surface on which horizontal rows of fence planking are fastened, the posts being spaced at intervals of several feet apart and imbedded in the ground, an article for use in protecting the fence posts from attack by yard mowing equipment comprising a generally circular plastic sleeve having a size and shape to conform and fit closely around a post near the ground having a flat portion and being slit on one side leaving juxtaposed ends of the sleeve in freely engageable alignment, the plastic sleeve having a relatively smooth surface compared to that of the post and being harder than the hardness of the wood from which the post is made and of sufficient width axially of the post in a vertical dimension adjacent to ground to protect the lower portion of the post from contact with the yard mowing equipment, and having a resilience circumjacent to post sufficient to bias the ends of the sleeve normally toward engageable alignment so as to substantially completely surround the post, said article being of approximately one-eighth inch thickness, and made of a thermo-setting plastic hardening to produce a surface harder than the posts and with a co-efficient of friction less than that of the surface of the posts.

2. The improvement as set forth in claim 1 of an article having a generally circular shape, of a diameter to resiliently encircle fence posts of the type used to fence in thoroughbred race horses, said juxtaposed ends of the plastic sleeve being slightly overlapped owing to the resilience of the sleeve in an unstressed condition prior to being stressed in placing it around a post.

3. The improvement as set forth in claim 1 of an article wherein one side of the sleeve is flattened to form a D-shaped cross section and the ends are yieldably separable to allow the ends of the sleeve to be separated 6 to 8 inches to fit snugly about the posts at the smaller dimension.

4. A method of landscaping existing fenced turf areas enclosed by wooden fencing comprising wooden posts of relatively uniform size and shape of generally circular cross section except for a flat surface on which horizontal rows of fence planking are fastened, the posts being spaced at intervals of several feet apart embedded in the ground, the posts and planking being treated against weathering to provide a uniform appearance to the fence above ground, and where powered mowing equipment is employed to trim the turf from around the posts, comprising the steps of:

(i) providing a generally circular plastic sleeve having a size and shape to conform and fit closely around a post near the ground having a flat portion and being slit on one side leaving juxtaposed ends of the sleeve in freely engageable alignment, the plastic sleeve having an even and uniformly smooth surface compared to that of the post and being harder than the hardness of wood from which the post is made and of sufficient width axially of the post in a vertical dimension adjacent to ground to protect the lower portion of the post from contact with the power mowing equipment, and having a resilience circumjacent to the post sufficient to bias the ends of the sleeve normally toward engageable alignment so as to substantially completely surround the post, (ii) separating the ends of a sleeve sufficiently to pass it around a post adjacent to ground, (iii) releasing the ends to allow the sleeve to yieldably conform to the post, while orienting it with the flat portion opposite the flat surface of the post and (iv) landscaping the individual posts substantially throughout the fenced turf area by repeating steps (i) (ii) and (iii) so that the sleeves when installed around the post are visually perceived as a part of the posts while protecting them against damage from periodic trimming of the turf from around the posts by the power mowing equipment.

5. A method of landscaping as set forth in claim 4 of providing a plastic sleeve having a thickness of from 0.06 to 0.08 inches and being from six to eight inches in diameter.

6. The method of landscaping as set forth in claim 4 of providing a plastic sleeve having opposed ends which overlap when encircling the post.

7. A method of landscaping as set forth in claim 4 of trimming the turf using a string cutter having a cutting element the hardness of which is less than that of the sleeve.

* * * * *